United States Patent [19]

Cors et al.

[11] Patent Number: 4,751,491

[45] Date of Patent: Jun. 14, 1988

[54] ELECTRIC/GAS OVEN THERMOSTAT

[75] Inventors: Craig M. Cors, Aurora; Joseph C. Kadlubowski, Willowbrook, both of Ill.

[73] Assignee: Harper-Wyman Company, Lisle, Ill.

[21] Appl. No.: 95,404

[22] Filed: Sep. 10, 1987

Related U.S. Application Data

[63] Continuation-in-part of Ser. No. 867,932, May 29, 1986, Pat. No. 4,710,742.

[51] Int. Cl.[4] ..... H01H 37/36; H01H 37/74

[52] U.S. Cl. ..... 337/312; 337/313; 337/318

[58] Field of Search ..... 337/313, 312, 317, 318, 337/319, 115, 119

[56] References Cited

U.S. PATENT DOCUMENTS 2,889,432 6/1959 Miller ..... 337/312

3,103,567 9/1963 Liebermann et al. ..... 337/318

*Primary Examiner*—H. Broome

*Attorney, Agent, or Firm*—Mason, Kolehmainen, Rathburn & Wyss

[57] ABSTRACT

A thermostat for use with an oven of an electric or gas range includes a first electrical contact terminal, a second electrical contact terminal and an actuating assembly including an actuating spring arm for opening and closing an electrical path between the first and second contact terminals. The spring arm has a fixed end mechanically and electrically coupled to the first electrical contact terminal by a movable support member and a free end that moves between a contacting position and a noncontacting position with the second electrical contact terminal. The manually operable mechanism is movable to an OFF position and to a plurality of ON positions for selecting an oven operating temperature. The temperature responsive mechanism is movable in response to changes in oven temperature. A positive-off mechanism maintains the noncontacting position of the spring arm responsive to the manually operated mechanism moved to the OFF position. The positive-off mechanism includes an integral pivotable arm having a pair of legs that are pivoted to engage the free end of the spring arm. The positive-off mechanism is arranged to provide effective and reliable operation and to avoid deformation of the spring arm, thereby extending the useful life of the thermostat.

10 Claims, 5 Drawing Sheets

ELECTRIC/GAS OVEN THERMOSTAT

RELATED APPLICATION

This application is a continuation-in-part of Ser. No. 867,932 filed May 29, 1986, now U.S. Pat. No. 4,710,742.

BACKGROUND OF THE INVENTION

A. Field of the Invention

The present invention generally relates to a thermostat, and more particularly, to a new and improved thermostat apparatus for controlling the temperature in an oven of an electric or gas stove.

B. Description of the Prior Art

Various known thermostats are in general satisfactory for their intended purpose; however, disadvantages of existing thermostats are that they are quite complicated and involve many moving parts, and are costly in manufacture. Typically complex over-travel mechanisms are employed to compensate for excess movement of the thermostat actuating assembly resulting from certain operations, such as turn off following a normal temperature control cycle.

It is highly desirable to provide an improved thermostat eliminating the need for conventional over-travel mechanisms. It is highly desirable to provide such improved thermostat having a positive-off mechanism that is simple in construction and that provides effective and reliable operation.

SUMMARY OF THE INVENTION

An object of the present invention is to provide a new and improved thermostat that avoids one or more of the problems of known thermostats.

Another object of the present invention is to provide a new and improved thermostat having an improved positive-off mechanism.

Briefly, in accordance with a preferred embodiment of the invention, a thermostat for use with an oven of an electric or gas range includes a first electrical contact terminal, a second electrical contact terminal and an actuating assembly including an actuating spring arm for opening and closing an electrical path between the first and second contact terminals. The spring arm has a fixed end mechanically and electrically coupled to the first electrical contact terminal by a movable support member and a free end that moves between a contacting position and a noncontacting position with the second electrical contact terminal. The spring arm is positioned for movement responsive to both a manually operable mechanism and a temperature responsive mechanism. The movable support member enables a coaxial alignment of the manually operable mechanism and the temperature responsive mechanism and provides a floating support for the spring arm, whereby the need for an over-travel mechanism is eliminated. The manually operable mechanism is movable to an OFF position and to a plurality of ON positions for selecting an oven operating temperature. The temperature responsive mechanism is movable in response to changes in oven temperature. A positive-off mechanism maintains the noncontacting position of the spring arm responsive to the manually operated mechanism moved to the OFF position. The positive-off mechanism includes an integral, pivotable arm having a pair of legs that are pivoted to engage the free end of the spring arm. The positive-off mechanism is arranged to provide effective and reliable operation and to avoid deformation of the spring arm, thereby extending the useful life of the thermostat.

DESCRIPTION OF THE DRAWING

These and other objects and advantages of the present invention will become readily apparent upon consideration of the following detailed description and attached drawing, wherein:

FIG. 1 is a front elevational view of a thermostat constructed in accordance with the principles of the present invention;

FIG. 5 is a cross-sectional view taken along the line 5—5 of FIG. 4;

DESCRIPTION OF THE PREFERRED EMBODIMENTS

Figure 2:
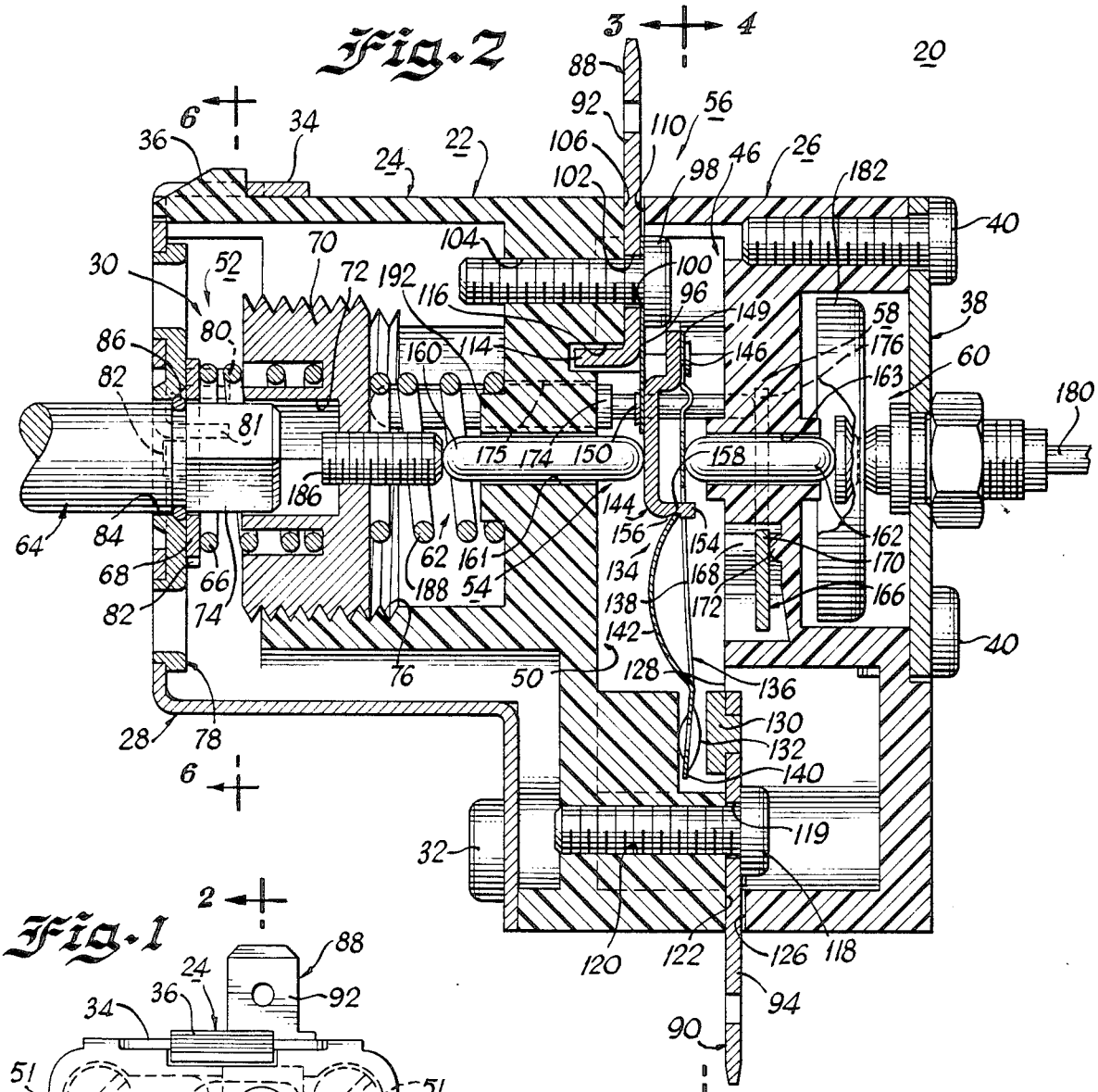
FIG. 2 is an enlarged cross-sectional view taken along the line 2—2 of FIG. 1.

Referring now to the drawings, FIGS. 1-13, there is illustrated a new and improved thermostat generally designated as 20 constructed in accordance with the principles of the present invention. The thermostat 20 performs a switching function for controlling the on-off condition of a heating element or burner control valve (not shown) of an oven of an electric or gas range to provide a selected oven temperature. Principles of the invention may be applied to thermostats of other types.

Figure 10:
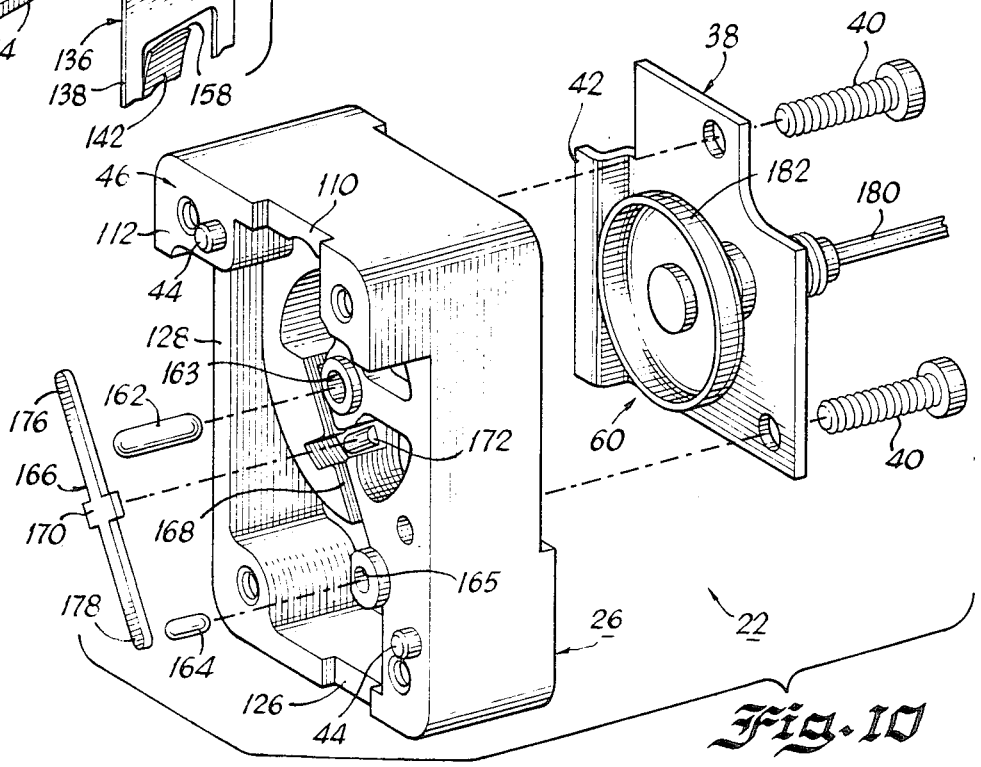
FIG. 10 is an exploded, perspective view of rear portions of the thermostat illustrated in FIG. 1.

The thermostat 20 includes a housing 22 formed by a front base section 24 (FIGS. 8 and 11) and a rear base section 26 (FIG. 10). A front cover 28 (FIG. 1) is mechanically secured to an open face 30 of the front base section 24 by a pair of fasteners 32. The front cover 28 includes a bail 34 positioned over a lug 36 molded on the front base section 24 to provide a snap fit of the cover 28 with the front base 24. A rear cover 38 is mechanically secured to the rear base section 26 by a pair of fasteners 40. The rear cover 38 includes an inwardly disposed side portion 42 arranged for positioning and retaining the cover 38 with the rear base section 26.

A pair of bosses 44 (FIG. 10) formed on an inner face 46 of the rear base section 26 are axially aligned with corresponding apertures 48 in a mating inner face 50 of the front base section 24. The housing sections 24 and 26 are additionally assembled together by a pair of fasteners 51.

As its major components, the thermostat 20 includes a push-to-rotate spindle assembly 52 for manual operation by a user of the oven between an OFF position and a range of ON positions for selecting oven temperature, an actuating assembly 54 for controlling contacting and noncontacting positions of a switch element 56, a positive off assembly 58 for maintaining the noncontacting position of the switch element 56 with the assembly 52 provided in the OFF positions, a temperature responsive assembly 60, and a calibration assembly 62.

In order to avoid accidental operation of the thermostat 20, the push-to-rotate spindle assembly 52 includes a spindle 64 that is rotatably engaged only by applying sufficient axial force to the spindle 64 to overcome the pressure exerted by a coiled spring 66 against a stop washer 68. A bushing 70 has a central axial, hex-shaped bore 72 configured for slideably receiving in interlocking engagement a distal hex-shaped end portion 74 of the rotary spindle 64. A threaded aperture 76 is formed in the front base section 24 for receiving the bushing 70.

Assembly 52 further includes a lock plate 78 (FIG. 11) secured to the front cover 28, for example, by welding. The lock plate 78 and the front cover 28 include an inwardly protruding tab member 80 and 81, respectively, for engaging a pair of tab members 82 formed on the stop washer 68 to limit the angular rotation of the spindle 64. The spindle 64 extends through a plurality of aligned apertures 84 within the front cover 28, the lock plate 78 and a retaining ring 86 for manual rotation between an OFF position and a range of ON positions for selecting oven temperatures, for example, between 140° and 550° F.

In operation, the spindle 64 is pushed in and rotated in a counterclockwise direction to move from the OFF position to a selected oven temperature. The rotation of the spindle 64 effects corresponding rotation of the bushing 70 within the threaded aperture 76 and the resulting axial movement of the bushing 70 is utilized for controlling the contacting and noncontacting positions of the switch element 56 as is later described.

The actuating assembly 54 (FIGS. 8 and 9) operates the switch element 56 that includes a pair of electrical contact terminals 88 and 90, each having a blade portion or terminal 92 and 94, respectively, extending through the housing 22 to which electrical connection is made in any conventional fashion. Contact 88 is secured to a hinge member 96 of the actuating assembly 54 by a fastener 98 that extends through an aperture 100 in the hinge member 96 and an aperture 102 in the contact terminal 88. The fastener 98 is received within a threaded aperture 104 within an upper recessed portion 106 of the inner face 50 of the housing section 24. A pair of outwardly extending positioning portions 108 are formed on the upper recessed portion 106. An aligned recessed portion 110 is formed within an upper, outwardly extending portion 112 of the mating inner face 46 of the housing section 26. The electrical contact terminal 88 is received and retained in alignment between the positioning portions 108 and within the recessed portion 110. A lower bent end portion 114 of the contact terminal 88 extends within a slot or recessed portion 116 of the housing section 24 (FIG. 2) additionally for positioning the contact terminal 88.

Contact terminal 90 is secured within the housing 22 by a fastener 118 that extends through an aperture 119 and is received within a threaded aperture 120. The threaded aperture 120 is formed within a lower outwardly extending portion 122 of the inner face 50 of the housing section 24. A pair of outwardly extending positioning portions 124 formed on the portion 122 and an aligned, recessed portion 126 formed in a lower recessed portion 128 of the inner face 46 define a channel for receiving and positioning the contact terminal 90. The contact terminal 90 includes a contacting portion 130 that is disposed for engagement with a contacting portion 132 of the actuating assembly 54.

Figure 8:
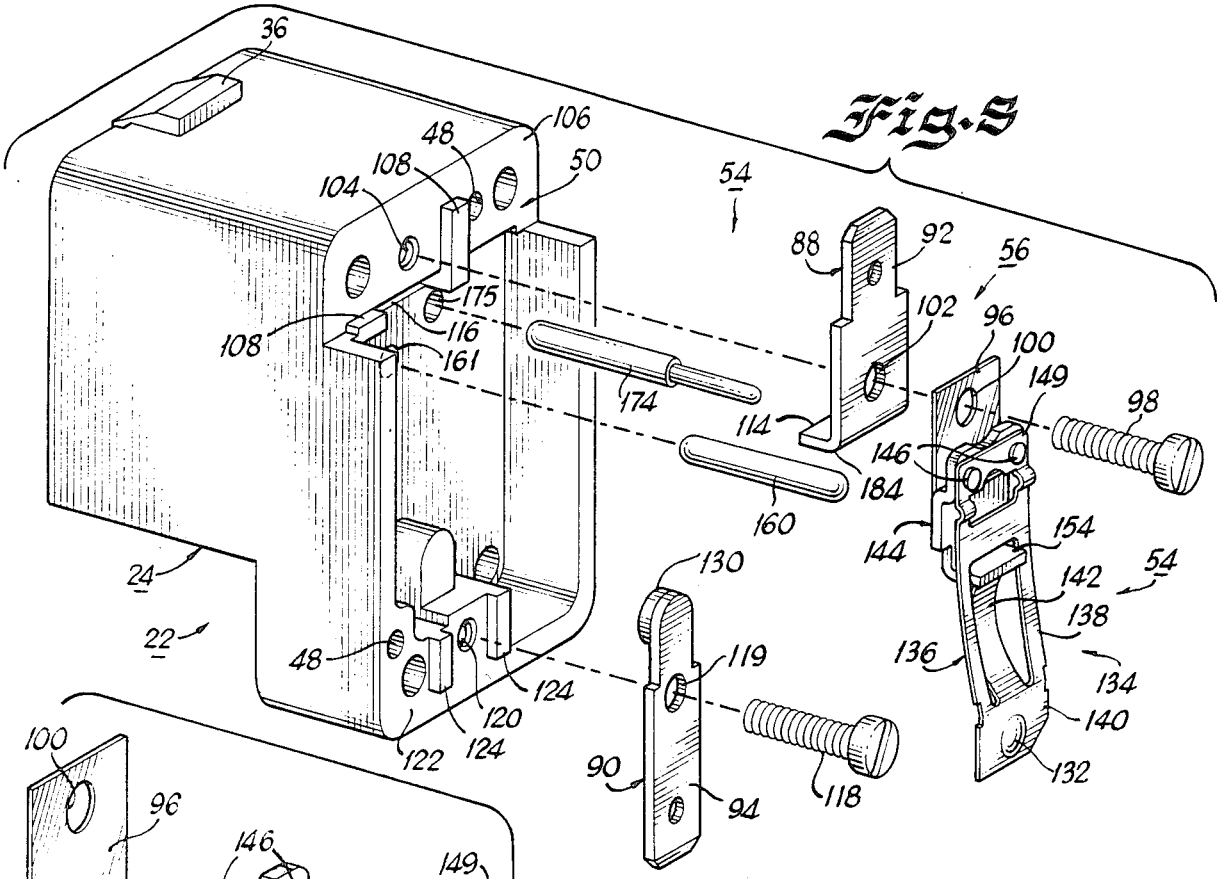
FIG. 8 is an exploded, perspective view of portions of the thermostat illustrated in FIG. 1.
Figure 9:
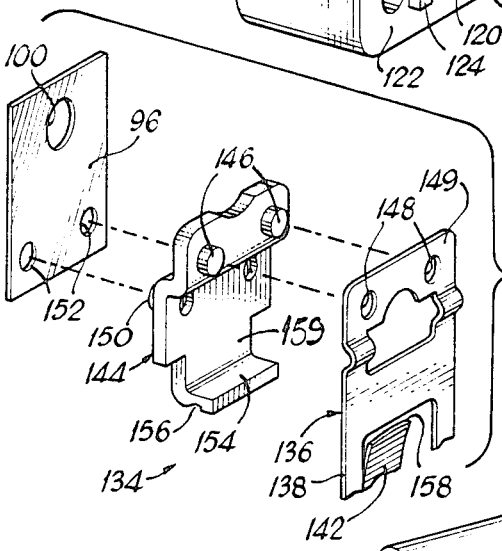
FIG. 9 is an exploded, perspective view of portions of the operating mechanism of the thermostat of FIG. 1.

Referring to FIG. 9, there is shown an exploded, perspective view of an upper portion of a snap spring assembly 134 of the actuating assembly 54. The snap spring assembly 134 includes a snap spring 136 having an elongated spring arm 138 with the contacting portion 132 carried by a free end portion 140 of the spring arm 138. A centrally disposed, bowed portion 142 of the spring arm 136 biases the snap spring 136. A support member 144 extends between and is fixedly secured to the snap spring 136 and the hinge 96, such as by staking. The hinge 96 allows for movement of the support member 144 providing a floating support for the snap spring 136. A pair of bosses 146 formed on an upper face of the support member 144 are received within corresponding, axially aligned apertures 148 within a fixed end portion 149 of the snap spring 136. A pair of bosses 150 formed on an opposite face of the support member 144 are received within corresponding axially aligned apertures 152 in the hinged member 96. A lower bent portion 154 of the support plate 144 includes a recessed portion 156 that engages a terminal end 158 of the bowed portion 142 of the spring arm 138 in the assembled condition (FIG. 8). A recessed portion 159 within the support member 144 allows for the movement of the temperature responsive assembly 60.

Actuating assembly 54 further includes a pair of axially aligned push rods 160 and 162 slideably received within a pair of bores 161 and 163 in the housing sections 24 and 26, respectively. The push rods 160 and 162 transmit forces to the snap spring assembly 134 for moving the contacting portion 132 into and out of engagement with the contacting portion 130 of the switch element 56.

Figures 3, 4, 6, 7:
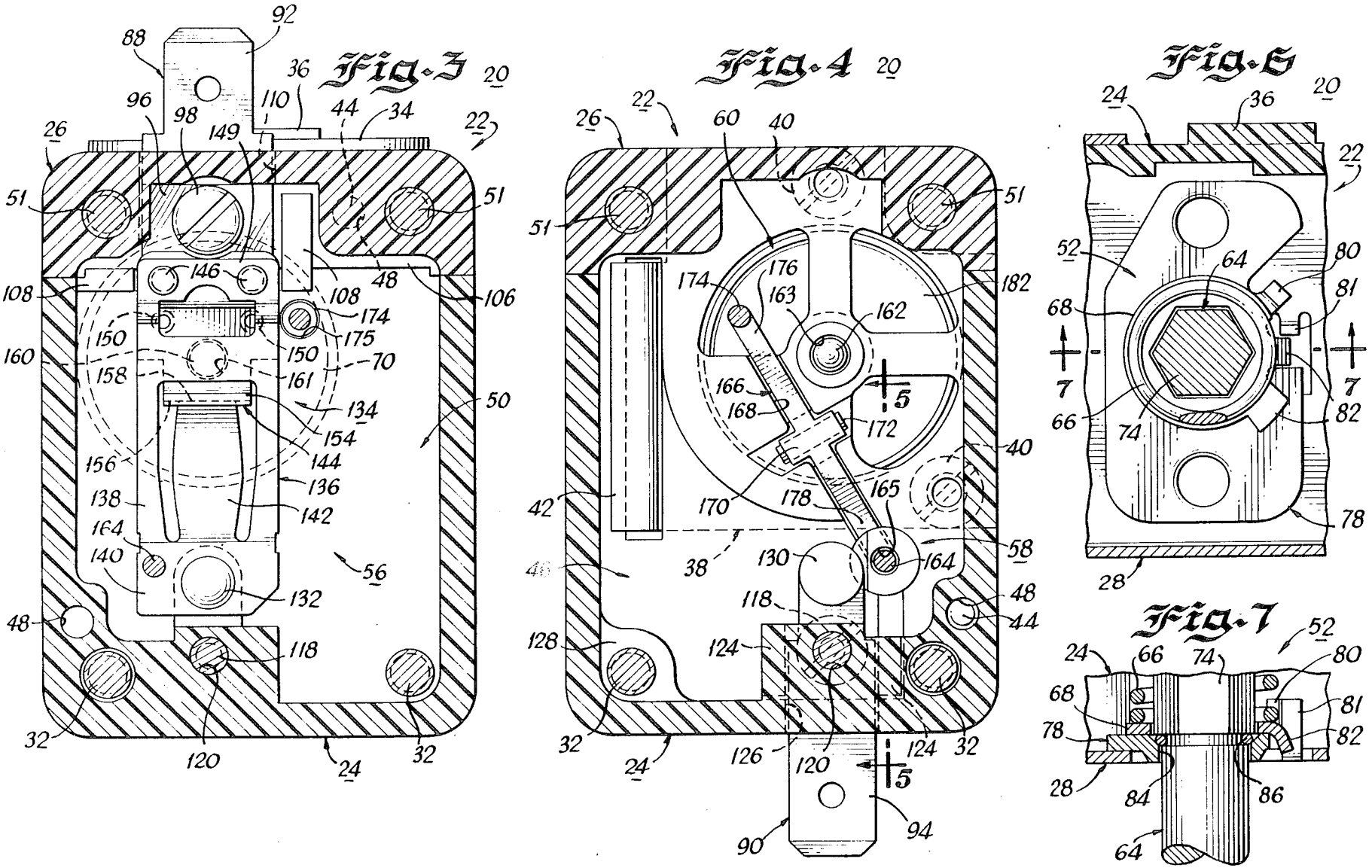
FIG. 3 is a cross-sectional view taken along the line 3—3 of FIG. 2.
FIG. 4 is a cross-sectional view taken along the line 4—4 of FIG. 2.
FIG. 6 is a fragmentary, cross-sectional view taken along the line 6—6 of FIG. 2.
FIG. 7 is a fragmentary, cross-sectional view taken along the line 7—7 of FIG. 6.

Referring to FIGS. 4, 5 and 10, a push rod 164 slideably received within a bore 165 in housing section 26 maintains the noncontacting position of the actuating spring arm 138 with the spindle assembly 52 in the OFF position. An actuating arm 166 of the positive-off assembly 58 is received by and positioned within an X-shaped channel 168 formed in the housing section 26. An enlarged, central portion 170 of the actuating arm 166 abuts an outwardly protruding pivot point 172 provided within the channel 168. Force is transferred to the actuating arm 166 from the spindle assembly 62 in the OFF position through a push rod 174 that is slideably received within a bore 125 in housing section 24. The push rod 174 extends between the bushing 70 and an end portion 176 of the actuating arm 166. An opposite end portion 178 of the actuating arm 166 is provided in force transferring engagement to the push rod 164.

Referring now to FIGS. 2 and 10, the temperature responsive assembly 60 is illustrated and includes a capillary tube 180 that extends within the oven and carries a fluid that expands in proportion to increased oven temperature. This fluid expansion is accommodated by an expansible diaphragm or bellows 182 disposed within the housing 22 and communicating with the capillary tube 180. Expansion of the bellows 182 causes the push rod 162 to push the actuating spring arm 138 past an over center position to open the contacting portions 130 and 132 for the oven temperature corresponding to the particular selected oven temperature.

Figure 13:
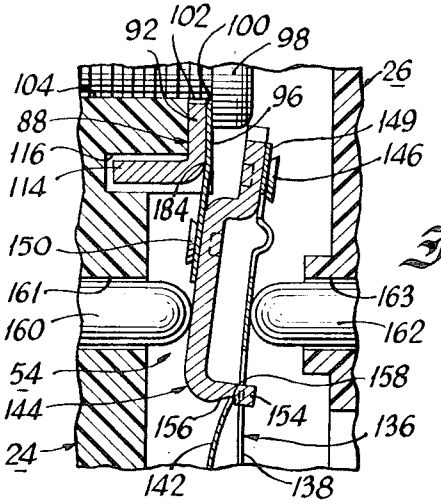
FIGS. 12 and 13 are enlarged, fragmentary details of the cross-sectional view of FIG. 2.
Figure 12:
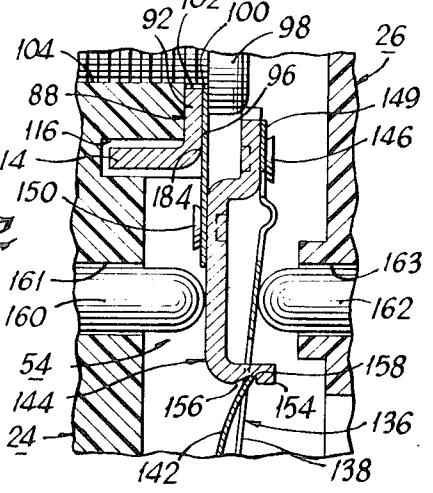
Figure 14:
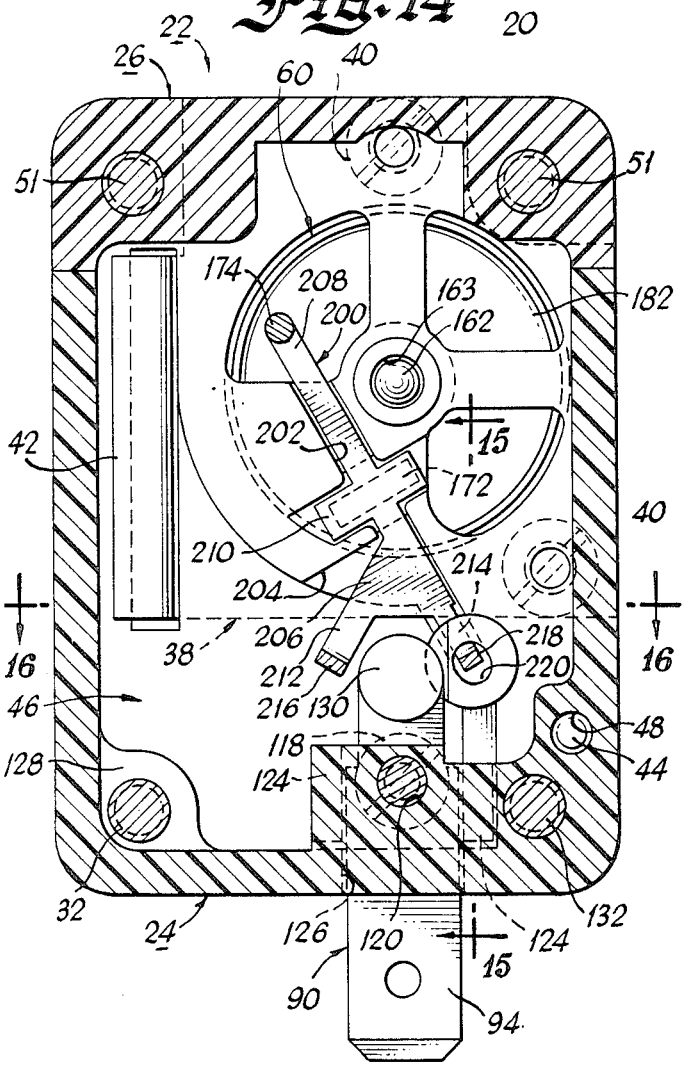
FIG. 14 is a cross-sectional view similar to FIG. 4 depict an alternative embodiment of the positive-off assembly for the thermostat of FIG. 1.
Figure 15:
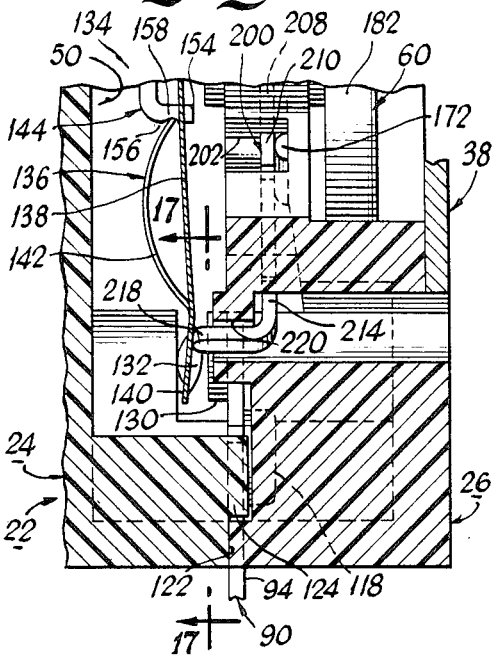
FIG. 15 is a cross-sectional view taken along the line 15—15 of FIG. 14.
Figure 17:
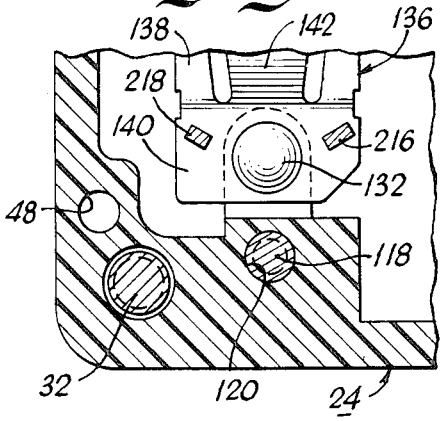
FIG. 17 is a cross-sectional view taken along the line 17—17 of FIG. 15.
Figure 16:
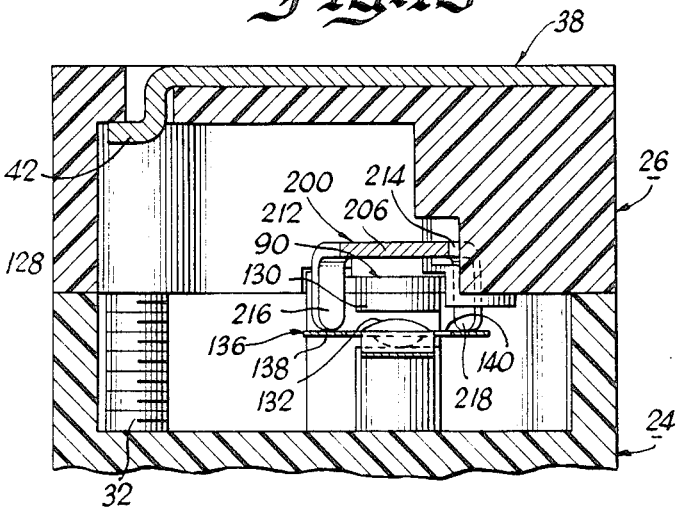
FIG. 16 is a cross-sectional view taken along the line 16—16 of FIG. 14.

Referring to FIGS. 12 and 13, the operation of the snap spring assembly 134 may be understood as follows. In response to the counterclockwise rotation of the spindle 64, the bushing 70 moves to the left (as shown in FIG. 2), releasing the positive-off assembly 58 and the push rod 160 moves in abutting engagement with the support member 144 to a set position for the particular selected oven temperature. The actuating spring arm 138 snaps closed moving the contacting portions 130 and 132 to the contacting position, resulting in energization of a heating element or admission of fuel to a burner.

The push rod 162 moves to the left proportional to increased oven temperature. The hinge 96 moves about a fulcrum 184 provided by the contact terminal 90. The push rod 162 pushes the actuating spring arm 138 past the over center position causing the contacting portions 130 and 132 to snap open to the noncontacting position upon reaching the selected oven temperature. The oven heating element is deenergized or fuel flow is discontinued by the noncontacting position of the switch element 56 and the oven temperature decreases. The push rod 162 moves to the right proportional to decreased oven temperature and allows the actuating spring arm 138 to snap closed moving the contacting portions 130 and 132 to the contacting position. The oven heating element is reenergized or fuel is again admitted to a burner. This cycle continues to maintain a set temperature until the spindle 64 is rotated to the OFF position.

When the spindle 64 is rotated to the OFF position ending the control cycle, the push rod 160 moves to the right. The recessed portion 159 of the floating support member 144 accommodates the push rod 162 and the spring arm 138 that is moved to the left (FIG. 2) responsive to the elevated oven temperature.

Figure 11:
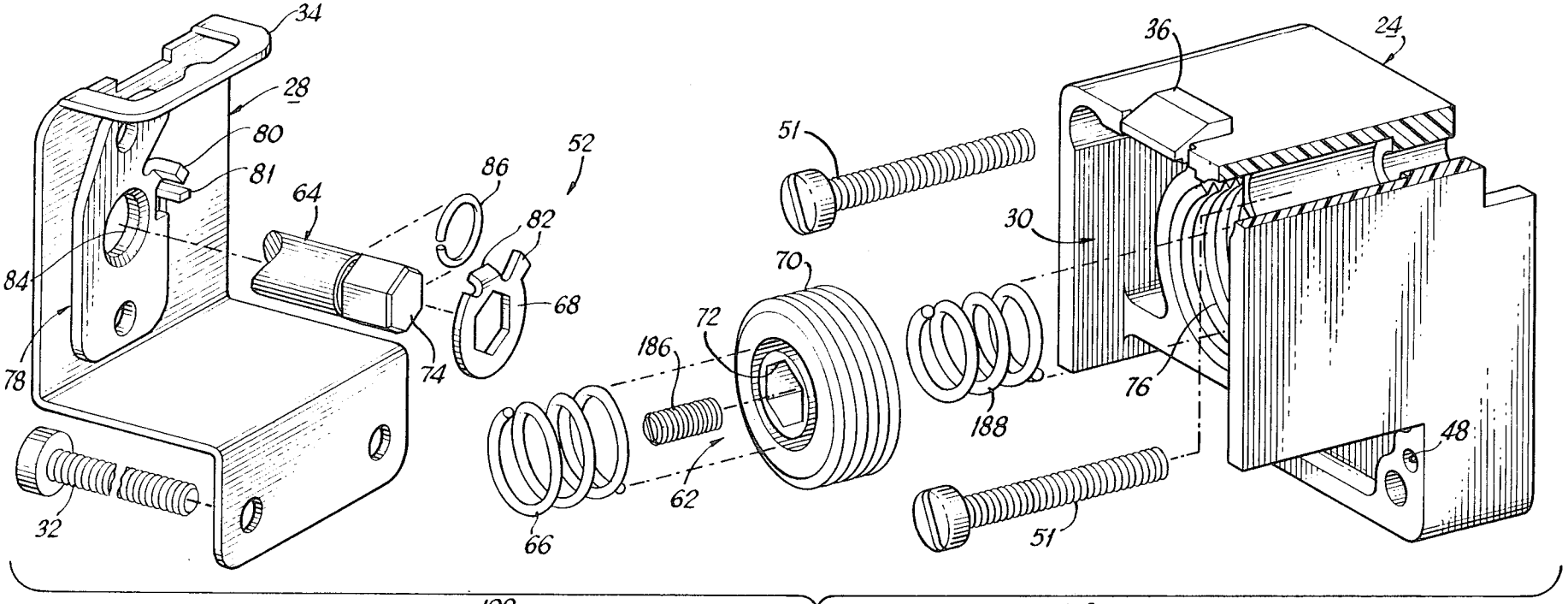
FIG. 11 is an exploded, perspective view of front portions of the thermostat of FIG. 1.

Referring now to FIGS. 2 and 11, the calibration assembly 62 includes a calibration screw 186 for adjusting the position of the push rod 160 relative to bushing 70 and a spring 188 for maintaining the effective calibration adjustment of the assembly 62. The calibration screw 186 is received within a threaded aperture 190 formed in the bushing 70 and is located in abutting engagement with the push rod 160. Extending between a positioning portion 192 (FIG. 2) formed in the housing section 24 and the bushing 70, the coiled spring 188 exerts pressure on the bushing 70 to retain the set position of the bushing 70 within the threaded aperture 72. The calibration screw 186 is carried for axial movement with the bushing 70 under the biasing influence of the spring 188. Fine adjustment of the calibration screw 186 precisely determines the position of the actuating assembly 54 relative to the temperature responsive assembly 60.

In accordance with an important feature of the invention, the calibration screw 186 may be adjusted for positioning the snap spring assembly 134 relative to the temperature responsive assembly 60 prior to mounting the spindle 64. The calibration assembly 62 is both separately arranged and spaced away from the push-to-engage spindle assembly 52 so that in the assembled condition, the calibration adjustment of screw 186 and the thermostat 20 is not changed by an impact to the spindle 64. The stop washer 68 in the assembly 52 engages the bushing 70 to limit the axial movement of the spindle 64 and to maintain a separation between the spindle 64 and the calibration screw 186. Alternately, the coiled spring 66 acts as a stop to limit the axial movement of the spindle 64 and to maintain the separation between the spindle 64 and the calibration screw 186.

Figure 18:
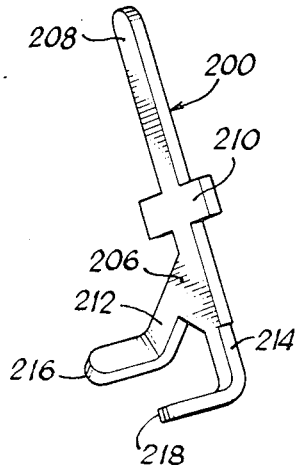
FIG. 18 is a perspective view of a positive-off activating arm of the alternative embodiment of the positive-off assembly of FIG. 14.

Referring to FIGS. 14-18, there is shown an alternative, preferred embodiment of the positive-off assembly 58 of the thermostat 20. The same reference characters as used in FIGS. 1-13 are used now for substantially unchanged portions and similar components of the thermostat 20. In the positive-off assembly of FIGS. 14-18, a positive-off actuating arm generally designated as 200 maintains the noncontacting position of the actuating spring arm 138 with the spindle assembly 52 in the OFF position. FIG. 18 provides a perspective view of the positive-off actuating arm 200 that is used instead of the combination of the actuating arm 166 and the push rod 164 (FIG. 10).

A channel 202 formed in the housing section 26 receives and positions the positive-off actuating arm 200. Channel 202 is similar to channel 168 including the outwardly protruding pivot point 172 and is modified to include a lower recessed portion 204 for receiving a lower portion 206 of the actuating arm 200.

As best shown in FIG. 18, the positive-off actuating arm 200 includes an upper end portion 208 for biasing engagement with the push rod 174. An enlarged portion 210 abuts the pivot point 172 within the channel 202. A pair of generally L-shaped legs 212 and 214 depend from the lower portion 206 of the actuating arm 200. An end portion 216 and 218 of the legs 212 and 214, respectively, extend outwardly to directly engage the free end portion 140 of the spring arm 138 so that an additional force transferring element such as push rod 164 is not required. The end portion 218 is received within a corresponding aperture or channel 220 (FIG. 15) in the housing section 26.

With the spindle 64 in the OFF position, the end portions 216 and 218 are provided in direct force transferring engagement to the free end portion 140 of the spring arm 138. This force acts on opposite sides of the contacting portion 132 to maintain the noncontacting position of the switch element 56. Distortion such as twisting of the actuating spring arm 138 is avoided by the force balancing arrangement provided by the positive-off actuating arm 200.

Although the present invention has been described in connection with details of the preferred embodiment, many alterations and modifications may be made without departing from the invention. Accordingly, it is intended that all such alterations and modifications be considered as within the spirit and scope of the invention as defined in the appended claims.

What is claimed and desired to be secured by Letters Patent is:

1. A thermostat for use with an oven of an electric or gas range comprising:

a first electrical contact;

a second electrical contact;

actuating means for opening and closing an electrical path between said first and second electrical contacts, said actuating means including a spring arm having a fixed end coupled to said first electrical contact and a free end moved between a contacting position and a noncontacting position with said second electrical contact;

manually operable means movable to an OFF position and to a plurality of ON positions for selecting an oven operating temperature;

said spring arm being operatively coupled to said manually operable means for moving from the noncontacting position to the contacting position with said second electrical contact when said manually operable means is moved from the OFF position;

temperature responsive means movable in response to changes in oven temperature;

said spring arm being operatively coupled to said temperature responsive means for moving from and to the contacting position upon increases and decreases in the oven temperature relative to the selected oven operating temperature; and positive-off means for maintaining the noncontacting position of said spring arm responsive to said manually operable means moved to the OFF position; said positive-off means including a pivotable arm operatively coupled to said manually operable means for pivotal movement in force transferring engagement with said spring arm free end.

2. A thermostat as recited in claim 1 wherein said positive-off means includes a push rod coupled between said manually operable means and said pivotable arm.

3. A thermostat as recited in claim 1 wherein said pivotable arm includes a pair of spaced apart legs for engaging opposite sides of said spring arm free end.

4. A thermostat as recited in claim 1 wherein said spring arm free end includes an outwardly projecting contacting portion being centrally disposed between the opposite sides thereof, and said pivotable arm includes a pair of spaced apart legs for engaging the opposite sides of said free end.

5. A thermostat for use with an oven of an electric or gas range comprising:

a first electrical contact;

a second electrical contact;

actuating means for opening and closing an electrical path between said first and second electrical contacts;

manually operable means movable to an OFF position and to a plurality of ON positions for selecting an oven operating temperature;

temperature responsive means movable in response to changes in oven temperature;

said actuating means being coupled to said manually operable means for closing said path between said first and second electrical contacts when said manually operable means is moved from the OFF position, said actuating means being coupled to said temperature responsive means for opening and closing said path between said first and second electrical contacts upon increases and decreases in oven temperature relative to the selected oven operating temperature, said actuating means including a snap spring assembly including a movable support member and a spring arm having a fixed end secured to said movable support member and a free end moved between a contacting position and a noncontacting position with said second electrical contact;

said movable support member being electrically and mechanically coupled to said first electrical contact;

said manually operable means and said temperature responsive means being coaxially aligned and being arranged for operatively engaging said snap spring assembly in opposed relationship; and positive-off means for maintaining the noncontacting position of said spring arm responsive to said manually operable means moved to the OFF position; said positive-off means including a pivotable arm operatively coupled to said manually operable means for pivotal movement in force transferring engagement with said spring arm free end.

6. A thermostat as recited in claim 5 wherein said positive-off means includes a push rod coupled between said manually operable means and said pivotable arm.

7. A thermostat as recited in claim 5 wherein said pivotable arm includes a pair of spaced apart legs for engaging opposite sides of said spring arm free end.

8. A thermostat as recited in claim 5 wherein said spring arm free end includes an outwardly projecting contacting portion being centrally disposed between the opposite sides thereof, and said pivotable arm includes a pair of spaced apart legs for engaging the opposite sides of said free end.

9. A thermostat as recited in claim 5 wherein said positive-off means includes a push rod drivingly coupled between said manually operable means and a first end of said pivotable arm and said pivotable arm is an integral member and includes a pair of generally L-shaped legs at a second end thereof, said legs being spaced apart and having end portions for engaging opposite sides of said spring arm free end.

10. A thermostat for use with an oven of an electrical gas range comprising:

a housing;

a pair of electrical contacts disposed within said housing, said contacts having terminal means extending through and outside said housing for electrical connections;

actuating means disposed within said housing for opening and closing an electrical path between said electrical contacts;

manually operable means movable to an OFF position and to a plurality of ON positions for selecting an oven operating temperature, said manually operable means including a spindle extending through and outside said housing and accessible for manual rotation and having a distal end portion and a bushing mounted within said housing and having an axial bore for receiving said distal end portion of said spindle in rotary interlocking engagement;

temperature responsive means for movement responsive to changes in oven temperature, said temperature responsive means being disposed within said housing and including an expansible diaphragm communicating with a temperature sensor disposed within the oven;

said actuating means comprising a snap spring assembly including a movable support member electrically and mechanically coupled to a first one of said electrical contacts, a spring arm having a fixed end secured to said movable support member and a free end moved into and out of engagement with a second one of said electrical contacts, a first push rod coupled between said support member and said bushing for closing said electrical path responsive to the axial movement of said bushing corresponding to the rotation of said spindle to a particular selected ON position; a second push rod coupled between said spring arm and said expansible diaphragm for opening said electrical path responsive to the selected oven temperature; said first and second push rods being coaxially aligned and being arranged for operatively engaging said snap spring assembly in opposed relationship; and positive-off means for opening said electrical path responsive to the rotation of said spindle to the OFF position, said positive-off means comprising a third push rod drivingly connected to said bushing, a pivotable arm extending between said third push rod and said spring arm free end, said pivotable arm including a pair of legs pivoted in force transferring engagement with said spring arm free end responsive to the axial movement of said bushing to the OFF position.

* * * * *